US010518956B2

(12) United States Patent
Wolf et al.

(10) Patent No.: US 10,518,956 B2
(45) Date of Patent: Dec. 31, 2019

(54) ASSEMBLY COMPRISING A FOIL PACK AND A DISPENSING DEVICE AND FOIL PACK

(71) Applicant: HILTI AKTIENGESELLSCHAFT, Schaan (LI)

(72) Inventors: Matthias Wolf, Gilching (DE); Wolfgang Ludwig, Zaisertshofen (DE)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 15/778,716

(22) PCT Filed: Dec. 13, 2016

(86) PCT No.: PCT/EP2016/080720
§ 371 (c)(1),
(2) Date: May 24, 2018

(87) PCT Pub. No.: WO2017/102680
PCT Pub. Date: Jun. 22, 2017

(65) Prior Publication Data

US 2018/0346227 A1 Dec. 6, 2018

(30) Foreign Application Priority Data

Dec. 18, 2015 (EP) ..... 15201024

(51) Int. Cl.
*B65D 81/32* (2006.01)
*B05C 17/005* (2006.01)
*B65D 83/00* (2006.01)

(52) U.S. Cl.
CPC .... *B65D 81/3244* (2013.01); *B05C 17/00556* (2013.01); *B05C 17/00583* (2013.01); *B65D 83/0055* (2013.01); *B05C 17/00503* (2013.01)

(58) Field of Classification Search
CPC ..... B65D 81/325; B65D 81/3244; B65D 83/0055–0077; B05C 17/00556;
(Continued)

(56) References Cited

U.S. PATENT DOCUMENTS 2,109,549 A * 3/1938 Piquerez ..... B65D 83/0055 222/95
2,777,612 A * 1/1957 Bensen ..... B65D 35/14 222/209
(Continued)

FOREIGN PATENT DOCUMENTS

DE 296 15 877 U1 11/1996
DE 10 2008 040 738 1/2010
(Continued)

OTHER PUBLICATIONS

WO2012136935_MT Machine Translation of WO2012/136935.*
(Continued)

*Primary Examiner* — Paul R Durand
*Assistant Examiner* — Randall A Gruby
(74) *Attorney, Agent, or Firm* — Grüneberg and Myers PLLC

(57) ABSTRACT

An assembly can be used for packaging chemical compounds. The assembly includes a foil pack for storage of a one-component or multicomponent compound, and a dispensing device for the foil pack. The foil pack has at least one elongated foil bag designed to be non-rigid, and one rigid head part having at least one fastening portion for one end of the foil bag and an outlet opening for discharge of the compound, where the dispensing device has at least one receptacle for pushing in the at least one film bag. The at least one elongated foil bag has, in a filled condition, the
(Continued)

form of a truncated cone, the diameter of which narrows in the direction of a longitudinal axis, starting from the respective fastening portion.

15 Claims, 2 Drawing Sheets

(58) Field of Classification Search
CPC ..... B05C 17/00583; B05C 17/00553; B05C 17/00573; B05C 17/00503
See application file for complete search history.

(56) References Cited

U.S. PATENT DOCUMENTS 4,574,987 A * 3/1986 Halligan ..... A23G 9/44 222/107
5,560,518 A * 10/1996 Catterall ..... B65D 35/28 222/99
5,667,102 A * 9/1997 Keller ..... B05C 17/00513 222/327
5,842,605 A * 12/1998 Lehmkuhl ..... B05B 11/3001 222/95
5,873,492 A * 2/1999 Sullivan ..... B05C 17/00516 222/105
5,893,485 A * 4/1999 McGill ..... A23G 3/02 100/125
6,158,621 A * 12/2000 Keller ..... B05C 17/00583 222/105
6,334,548 B1 1/2002 Ichikawa et al.
6,521,158 B2 2/2003 Ichikawa et al.
6,681,957 B1 1/2004 Green
6,736,290 B2 5/2004 Ichikawa et al.
6,880,725 B2 * 4/2005 De Laforcade ..... B65D 81/32 222/105
7,137,531 B2 * 11/2006 Arghyris ..... B05B 11/3023 222/94
8,028,859 B2 * 10/2011 Paetow ..... B65D 81/3244 222/107
8,281,956 B2 * 10/2012 Cadden ..... B05C 17/00503 222/105
9,290,280 B2 * 3/2016 Moretti ..... B29C 63/26
9,579,686 B2 * 2/2017 Springhorn ..... B05C 17/00586
10,005,259 B2 * 6/2018 Julien ..... B32B 1/02
10,150,607 B2 * 12/2018 Bates ..... B65D 81/325
2002/0056726 A1 5/2002 Ichikawa et al.
2003/0089736 A1 * 5/2003 Ichikawa ..... B05C 17/00576 222/105
2003/0091773 A1 5/2003 Ichikawa et al.
2005/0147761 A1 * 7/2005 Parks ..... B01F 5/0615 427/421.1
2005/0260041 A1 * 11/2005 Ludwig ..... F16B 13/146 405/259.6
2006/0124663 A1 * 6/2006 Salemme ..... B65D 83/62 222/95
2006/0163287 A1 * 7/2006 Boumnso ..... B65D 83/0055 222/209
2009/0084815 A1 * 4/2009 Paetow ..... B65D 81/3244 222/94
2009/0216183 A1 * 8/2009 Minotti ..... A61M 15/08 604/82
2009/0272761 A1 * 11/2009 Cadden ..... B05C 17/00503 222/1
2009/0277926 A1 * 11/2009 Schell ..... B65D 81/3244 222/94
2010/0027918 A1 * 2/2010 Willner ..... B05O 17/00553 383/37
2010/0059547 A1 * 3/2010 Schell ..... B65D 81/325 222/137
2011/0297275 A1 * 12/2011 Farrar ..... B05B 11/0056 141/113
2012/0017412 A1 * 1/2012 Pierson ..... B65D 81/325 29/428
2012/0267394 A1 * 10/2012 Pierson ..... A61C 9/0026 222/94
2013/0026182 A1 * 1/2013 Habibi-Naini .... B05C 17/00509 222/94
2013/0270294 A1 * 10/2013 Shibata ..... B65D 83/48 222/94
2014/0117041 A1 * 5/2014 Springhorn ..... B05C 17/00586 222/83
2014/0246454 A1 * 9/2014 Schulz ..... B65D 81/325 222/82
2014/0246515 A1 * 9/2014 Nakajima ..... B65D 83/682 239/307
2015/0129615 A1 * 5/2015 Bates ..... B65D 81/325 222/145.5
2015/0231658 A1 * 8/2015 Werner ..... B05B 15/20 222/145.6
2016/0128915 A1 * 5/2016 Konno ..... A61Q 5/10 424/62

FOREIGN PATENT DOCUMENTS

EP 2 045 196 4/2009
JP 2000-309355 11/2000
JP 2009-83935 4/2009
WO 2011/040584 4/2011
WO 2012/136935 10/2012
WO 2015/164817 10/2015

OTHER PUBLICATIONS

International Searching Authority mailed in PCT/EP2016/080720 dated Feb. 6, 2017, with English translation.
Written Opinion of the International Searching Authority mailed in PCT/EP2016/080720 dated Feb. 6, 2017.

* cited by examiner

ASSEMBLY COMPRISING A FOIL PACK AND A DISPENSING DEVICE AND FOIL PACK

This application is a National Stage entry under § 371 of International Application No. PCT/EP2016/080720, filed on Dec. 13, 2016, and claims priority to European Patent Application No. 15201024.5, filed on Dec. 18, 2015.

DESCRIPTION

The invention relates to an assembly comprising a foil pack for storing a one-component or multicomponent compound and a dispensing device for the foil pack, wherein the foil pack has at least one elongated foil bag designed to be intrinsically non-rigid and one intrinsically rigid head part with at least one fastening portion for one end of the foil bag and an outlet opening for letting out the compound, and wherein the dispensing device has at least one receptacle for pushing in the at least one foil bag. Furthermore, the invention relates to a foil pack for such an assembly, with at least one elongated foil bag designed to be intrinsically non-rigid and one intrinsically rigid head part with at least one fastening portion for one end of the foil bag.

Such foil packs have proved useful in the past as packaging for chemical compounds, such as, for example, mortar, foam, plugging or sealing compounds that consist of one or more components. In particular, compared with cartridges, they are characterized by more cost-effective and simpler manufacturing as well as by a smaller proportion of material to be disposed of after use.

To apply the compound, the foil pack is usually pushed into a receptacle of a squeezing-out device, for example a dispenser. Via a dispensing mechanism, the one-component or multicomponent compound is dispensed through an outlet opening in the head part and then (at least in the case of a multicomponent compound) is passed for better mixing through a mixer attachment having a mixer element.

DE 10 2008 040 738 A1 discloses a foil pack of the type mentioned in the introduction, which has two foil bags disposed laterally alongside one another, is able to receive the two-component and multicomponent compounds and is suitable for being pushed into a dispensing device having two receptacles disposed alongside one another.

In order to permit the foil pack to be pushed axially into the receptacle without problems, a gap is needed between the outside wall of the foil and the inside wall of the receptacle. During emptying of the foil pack, for example by means of a plunger that can be displaced in the receptacle, the foil of the foil bag or bags is stretched, whereby the foil comes to bear on the inside wall of the receptacle. In the process, the foil is widened, and the optionally different foils of the individual bags are subjected to different stresses, which lead to uneven squeezing of the various components during relaxation of the pressure. This expansion and recovery of the foil bags is also known as pumping, which leads to discrepancies in the mixing ratio, especially during the startup behavior.

It is therefore an object of the invention to provide a foil pack or an assembly comprising foil pack and dispensing device, in which the undesired expansion and recovery of the foils is effectively prevented.

According to a first aspect of the invention, it is provided for this purpose in an assembly of the type mentioned in the introduction that the at least one foil bag has, in the filled condition, the form of a truncated cone, the diameter of which narrows in the direction of its longitudinal axis, starting from the fastening portion, and that the at least one receptacle has a frustoconical inner circumferential wall, which in particular is shaped to be complementary to the foil bag, wherein the at least one foil bag, in the fully pushed-in condition, bears with full surface contact on the inner circumferential wall of the receptacle.

In the inventive configuration, therefore both the at least one foil bag and the associated receptacle have slightly inclined circumferential walls, which makes it possible to push the foil bag into the associated receptacle even without providing a joint gap. After the foil bag has been completely pushed in, the foil outside wall bears with full surface contact on the inside wall of the receptacle, whereby expansion and recovery of the foil bag during emptying is reliably prevented. In the completely pushed-in condition, the inner circumferential wall of the receptacle offers complete support for the foil bag, and so this cannot experience any expansion even under pressure and thus also no recovery occurs. In this way, the undesired pumping is avoided. Moreover, compared with a foil bag of plain cylindrical construction, much easier pushing in is possible due to the inclination.

According to a preferred embodiment, the cone angle or opening angle of the truncated cone lies in the range of 0.1° to 10°, especially of 2° to 6°. Thus the foil bag or bags as well as the receptacle(s) are provided only with a slight inclination, whereby introduction is facilitated and a joint gap can be avoided. At the same time, an only slight inclination of the circumferential walls permits reliable dispensing of the contained compound(s) by means of a plunger (each) guided in the receptacle. Since the diameter of the foil bag increases only slightly from the end at which the plunger is applied to the other end fixed to the fastening portion of the foil bag, the foil bag is completely emptied even by use of a conventional plunger.

According to a preferred embodiment, the foil pack has a first foil bag and a second foil bag disposed alongside the first foil bag for components of a multicomponent compound stored separately from one another, wherein both foil bags have frustoconical shape. In this way the foil pack is suitable for storage of a two-component compound, which is intermixed only during dispensing. Naturally, it is possible to provide several bags for storage of more than two components, or alternatively to form one or more foil bags with several chambers, in which several different components can be stored separately from one another.

Preferably, the head part then has a first fastening portion for one end of the first foil bag and a second fastening portion disposed laterally alongside it for one end of the second foil bag, especially wherein a straight-through duct is provided from each foil bag in the head part and the straight through ducts in the head part discharge into a common outlet opening. Usually a mixer attachment is screwed onto the outlet opening, which ensures simple mixing of the two or more components stored in the two foil bags directly during dispensing.

In this connection, the dispensing device preferably has a first receptacle for the first foil bag and a second receptacle disposed laterally alongside it for the second foil bag, wherein both receptacles have inner circumferential walls tapering conically in the direction of their longitudinal axis. Thus reliable full-surface support of the outside walls of both foil bags is ensured.

In a preferred embodiment, the two foil bags have the same cone angle and therefore the same inclination relative to the longitudinal axis, which from the production-related viewpoint is more favorable, especially in regard to the associated receptacles.

Alternatively, the two frustoconical foil bags may have different cone angles. What is decisive is that the respective associated receptacle has a cone angle matched to the cone angle of the foil bag.

In particular, the two foil bags are produced from foils with different mechanical properties. By virtue of the full-surface support of the foil bags in the respective receptacle, expansion and recovery of the foil bags is indeed reliably prevented, and so matching of the mechanical properties of the various foil bags is no longer necessary in the inventive configuration.

In a preferred configuration of the invention, the first foil bag has a greater diameter along its entire length than does the second foil bag. For the same length, therefore, the first foil bag has a greater volumetric capacity, which permits a mixing ratio of the two components different from 1:1 ratio. In principle, any desired mixing ratio of the components can be achieved via the diameter of the bags.

According to a second aspect of the invention, the object stated hereinabove is likewise solved by a foil pack of the type mentioned in the introduction, in which the at least one receptacle has, in the filled condition, the form of a truncated cone, the diameter of which decreases in the direction of its longitudinal axis, starting from the fastening portion. Such a foil pack can also be pushed without problems into the receptacle of a dispensing device even without providing a joint gap, and it permits the foil bag in the completely pushed-in condition to bear with full surface contact on an inner circumferential wall of the receptacle, whereby the undesired expansion and recovery of the foil bag is reliably prevented during dispensing of the compound from the foil bag.

In a preferred embodiment, the foil pack has a first foil bag and a second foil bag disposed alongside the first foil bag for components of a multicomponent compound stored separately from one another, wherein both foil bags have frustoconical shape. This permits storage and preparation of multicomponent compounds.

Preferably, the head part has a first fastening portion for one end of the first foil bag and a second fastening portion disposed laterally alongside it for one end of the second foil bag, especially wherein a straight-through duct is provided from each foil bag in the head part and the straight through ducts in the head part discharge into a common outlet opening. Thereby space-saving storage and simple mixing of a two-component compound are achieved.

Beyond this all improvements and advantages mentioned with reference to the inventive assembly are also valid for the inventive foil pack and vice versa.

Further features and advantages will become apparent from the description hereinafter of a preferred embodiment on the basis of the attached drawings, wherein.

Figure 1:
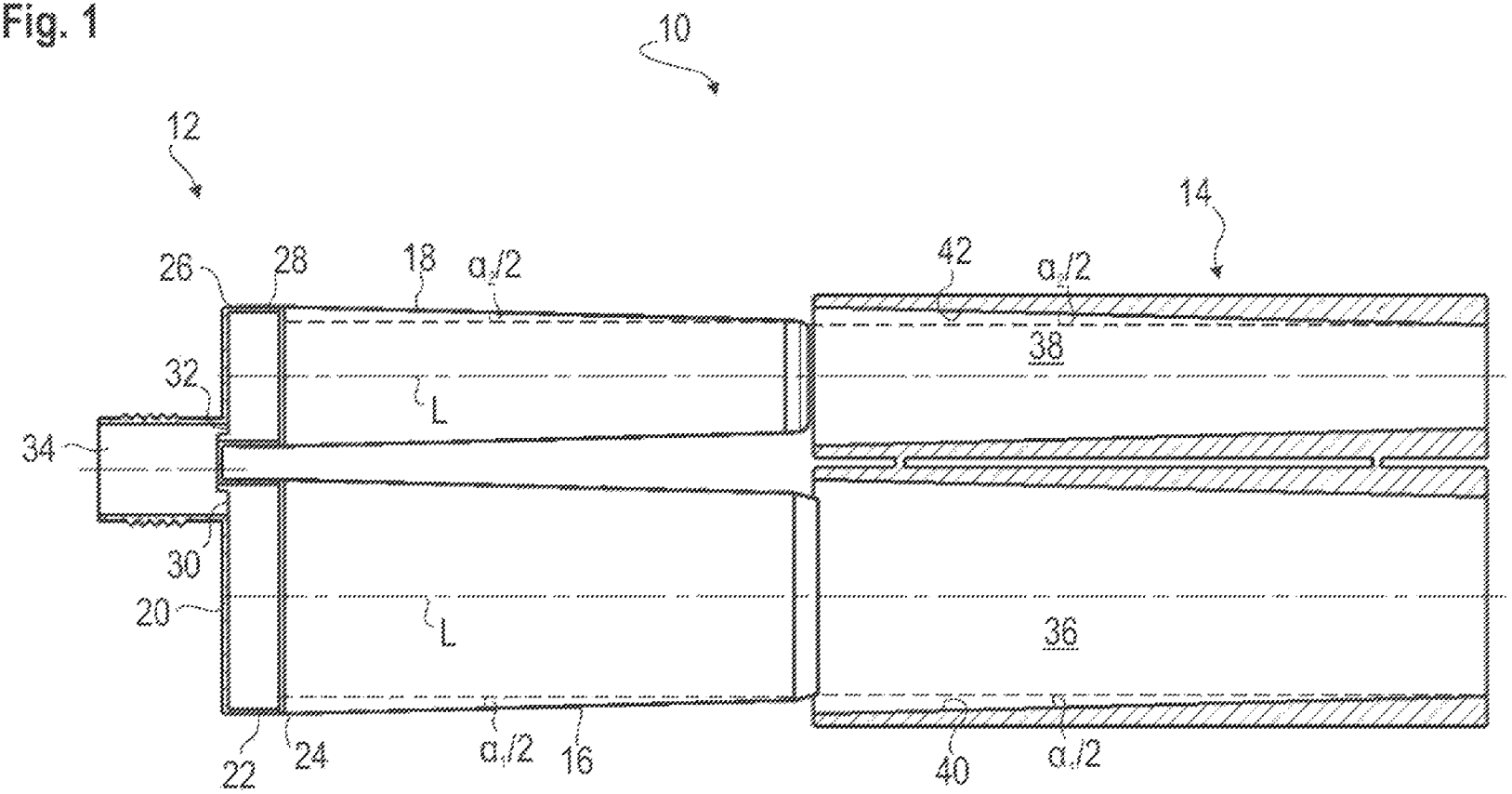
FIG. 1 shows a sectional view of an inventive assembly before the foil pack is pushed into the dispensing device.
Figure 2:
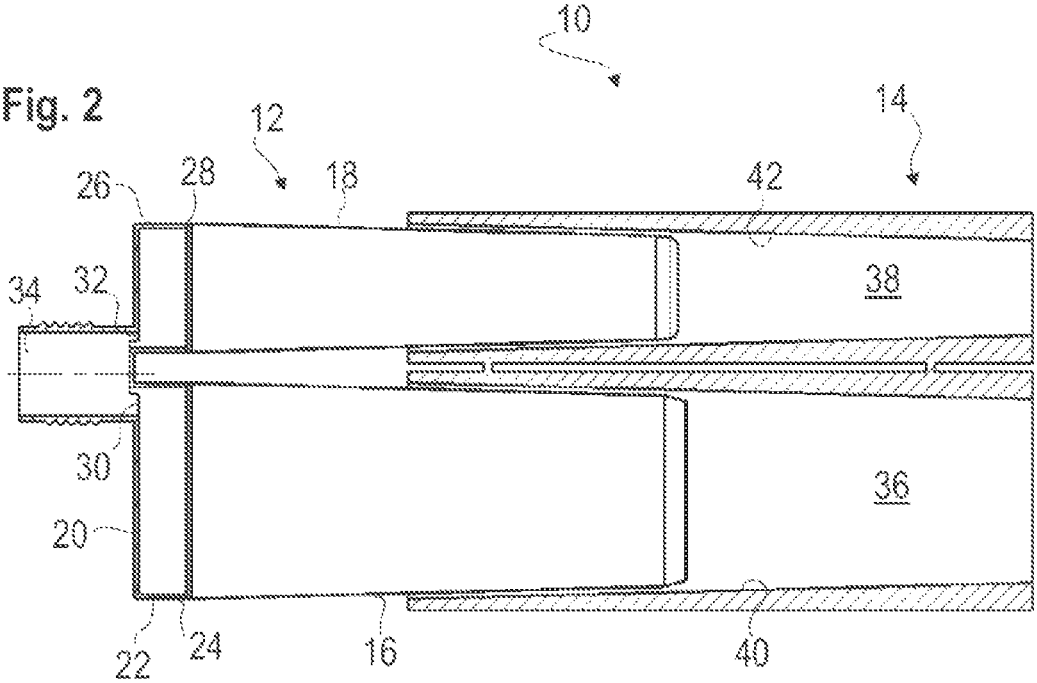
FIG. 2 shows a sectional view of the assembly from FIG. 1, wherein the foil pack is partly pushed into the dispensing device.
Figure 3:
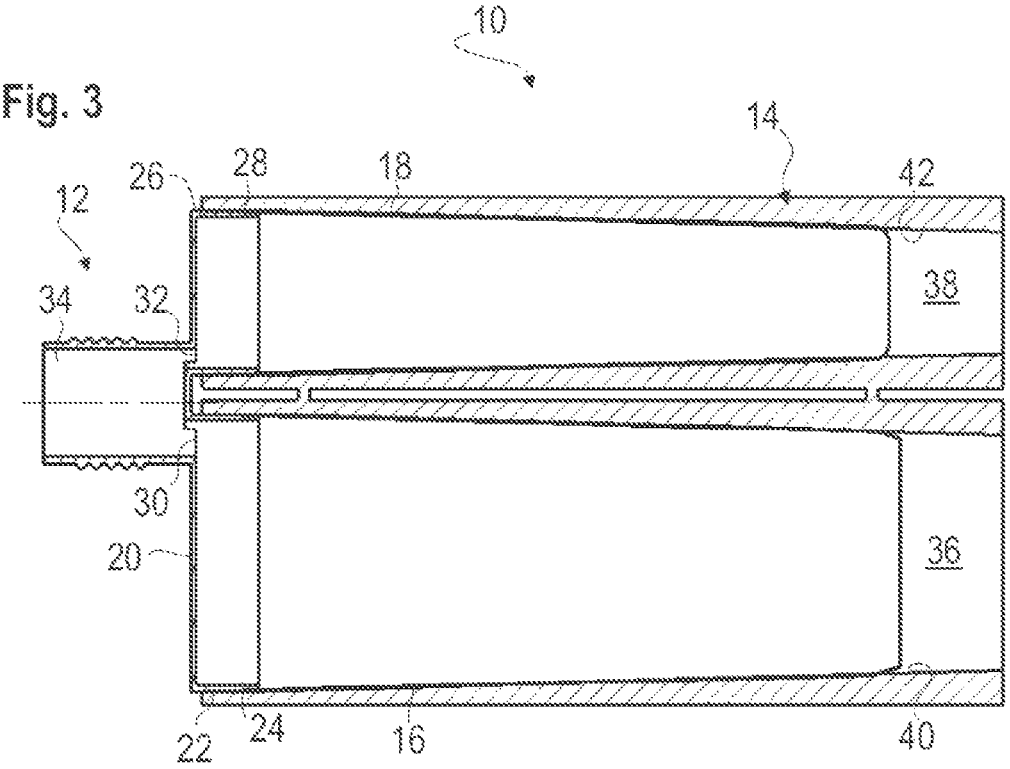
FIG. 3 shows a sectional view of the inventive assembly in an end position, in which the foil pack has been pushed completely into the dispensing device.

FIGS. 1 to 3 show an inventive assembly 10, which is provided with a foil pack 12 for storage of in this case a two-component compound and with a dispensing device 14 for foil pack 12.

Foil pack 12 comprises a first filled foil bag 16 as well as a second, filled foil bag 18 disposed laterally alongside first foil bag 16, which bags are used to retain the components of the two-component compound in storage separately from one another. Foil bags 16, 18 themselves are elongated and (without contents) are designed to be intrinsically non-rigid.

Furthermore, foil pack 12 comprises an intrinsically rigid head part 20, which has a first fastening portion 22, on which one end 24 of first foil bag 16 is fixed. A second fastening portion 26 for one end 28 of second foil bag 18 is provided laterally alongside first fastening portion 22. Both foil bags 16, 18 are undetachably fixed on head part 20. Beyond this, two straight-through ducts 30, 32 are formed in head part 20, each of which joins one of the foil bags 16, 18 with a common outlet opening 34. A mixer attachment (not shown) is usually screwed onto this.

Both foil bags 16, 18 have the form of a truncated cone, the diameter of which narrows in the direction of a longitudinal axis L of the foil bags 16, 18, starting from the respective fastening portion 22 or 26. In this connection, both the cone angle $\alpha_1$ of first foil bag 16 and the cone angle $\alpha_2$ of second foil bag 18 lie in the range of 0.1° to 10°, especially of 2° to 6°. In the shown embodiment, both cone angles $\alpha_1$ and $\alpha_2$ are approximately 4°, as is evident in FIG. 1, in which, for space reasons, the angles of inclination $\alpha_1/2$ and $\alpha_2/2$, which indeed correspond exactly to the respective half cone angle, are indicated instead of the actual cone angles $\alpha_1$ and $\alpha_2$.

First foil bag 16 has a greater diameter along its entire length than does second foil bag 18, as can be inferred from the figures. Consequently, first foil bag 16 has a larger volume of the two-component compound, whereby this component predominates in the finish-mixed compound. In principle, the mixing ratio of the two-component compound is adjustable via the volume or diameter ratio of foil bags 16, 18.

Dispensing device 14, which is shown only partly in the figures (without illustration of the actual dispensing mechanism, for example in the form of one or more plungers), has a first receptacle 36 for first foil bag 16 as well as a second receptacle 38, disposed laterally alongside it, for second foil bag 18. Both receptacles 36, 38 have a frustoconical inner circumferential wall 40 and 42 shaped to be complementary to the associated foil bag 16, 18 and respectively tapering conically in the direction of longitudinal axis L. The cone angles $\alpha_1$, $\alpha_2$ of these internal circumferential walls 40, 42 correspond to those of the respectively associated foil bags 16, 18.

FIG. 2 shows a middle position, in which foil pack 12 is partly pushed approximately halfway into dispensing device 14. By virtue of the frustoconical shape both of foil bags 16, 18 and of receptacles 36, 38, there is no need here to provide a joint gap, as is known for conventional plain cylindrical foil bags. In addition, pushing in is simpler because of the inclination of the participating walls.

Finally, FIG. 3 illustrates the end position 16, 18, in which both foil bags are completely pushed into the respective associated receptacle 36, 38. In this completely pushed-in condition, both foil bags 16, 18 bear with full surface contact on the respective internal circumferential wall 40 or 42 of the associated receptacle 36, 38.

By virtue of this complete support or full surface contact in the end position, no matching of the mechanical properties is needed in the inventive embodiment, and so the two foil bags 16, 18 may be made from foils with different mechanical properties.

The invention claimed is:

1. An assembly, comprising:

a foil pack for storage of a one-component or multicomponent compound, and a dispensing device for the foil pack, wherein the foil pack has at least one elongated foil bag designed to be non-rigid, and one rigid head part comprising at least one fastening portion for one end of the foil bag and an outlet opening for discharge of the compound, wherein the dispensing device has at least one receptacle for the at least one foil bag, wherein the at least one elongated foil bag has, in a filled condition, the form of a truncated cone, the diameter of which narrows in the direction of a longitudinal axis, starting from the at least one fastening portion, wherein the at least one receptacle has a frustoconical inner circumferential wall which is shaped complementary to the foil bag, and wherein, in a fully pushed-in condition, an outer surface of the foil bag and the inner circumferential wall of the receptacle are in contact.

2. The assembly according to claim 1, wherein the truncated cone has a cone angle in a range of from 0.1° to 10°.

3. The assembly according to claim 1, wherein the foil pack has a first foil bag and a second foil bag disposed alongside the first foil bag for components of a multicomponent compound stored separately from one another, and wherein each foil bag has a frustoconical shape.

4. The assembly according to claim 3, wherein the head part has a first fastening portion for one end of the first foil bag and a second fastening portion disposed laterally alongside the head part for one end of the second foil bag.

5. The assembly according to claim 3, wherein the dispensing device has a first receptacle for the first foil bag and a second receptacle, disposed laterally alongside the first receptacle, for the second foil bag, and wherein each receptacle has an inner circumferential wall tapering conically in a direction of a longitudinal axis thereof.

6. The assembly according to claim 3, wherein a cone angle of each foil bag is the same.

7. The assembly according to claim 3, wherein each foil bag comprises a foil that has different mechanical properties from each other foil in each other foil bag.

8. The assembly according to claim 3, wherein the first foil bag has a greater diameter along an entire length thereof compared to a diameter of the second foil bag.

9. The assembly according to claim 3, wherein the head part has a first fastening portion for one end of the first foil bag and a second fastening portion, disposed laterally alongside the first fastening portion, for one end of the second foil bag, wherein a straight-through duct is provided from each foil bag in the head part, and wherein the straight-through ducts in the head part discharge into a common outlet opening.

10. The assembly according to claim 1, wherein the truncated cone has a cone angle in a range from 2° to 6°.

11. An assembly, comprising:

a head including an outlet, at least one first bag and at least one second bag, each fastened to the head, a dispenser including a first receptacle for the at least one first bag and a second receptacle for the at least one second bag, wherein the first receptacle has an inner wall having a diameter tapered at a first angle with respect to a center line of the at least one bag, wherein the at least one first bag includes an outer surface having a diameter which is tapered at a second angle with respect to a center line of the at least one first bag when the at least one first bag includes a first component, wherein the second angle corresponds to the first angle, wherein an outer surface of the second bag and an inner wall of the second receptacle are tapered at corresponding angles when the second bag includes a second component, and wherein a diameter of the at least one bag increases in a direction toward the head.

12. The assembly according to claim 11, wherein the outer surface of the at least one bag is in contact with the inner wall of the receptacle when the at least one bag is in the first receptacle and full of the first component.

13. The assembly according to claim 11, wherein the first bag includes a first material, the second bag includes a second material, and the first material and the second material have different mechanical properties.

14. The assembly according to claim 11, wherein the head includes a first duct and a second duct, the first duct is between the first bag and the outlet, the second duct is between the second bag and the outlet, and the outlet is to output a mixture of the first component and the second component.

15. The assembly according to claim 11, wherein the at least one bag includes foil.

* * * * *